United States Patent [19]

Wilks et al.

[11] Patent Number: 4,586,453

[45] Date of Patent: May 6, 1986

[54] LAUNCHING APPARATUS FOR BOATS

[75] Inventors: Thomas M. Wilks, Cowes; Simon P. K. Pope, Romsey, both of England

[73] Assignee: Watercraft Limited, Gosport, England

[21] Appl. No.: 621,742

[22] Filed: Jun. 18, 1984

[30] Foreign Application Priority Data

Jun. 21, 1983 [GB] United Kingdom ..... 8316876

[51] Int. Cl.[4] ..... B63B 23/02

[52] U.S. Cl. ..... 114/368; 114/369; 114/379

[58] Field of Search ..... 114/365–369, 114/370–374, 377–380; 441/80, 87

[56] References Cited

U.S. PATENT DOCUMENTS

| | | | |
|---|---|---|---|
| 1,043,625 | 11/1912 | Petrie | 114/370 |
| 1,280,217 | 10/1918 | Harvey | 114/379 |
| 2,761,571 | 9/1956 | Adams | 114/366 |
| 2,780,196 | 2/1957 | Jareckie | 114/370 |
| 3,778,855 | 12/1973 | Kariagin et al. | 114/368 |
| 3,796,281 | 3/1974 | Dowling | 441/80 |

FOREIGN PATENT DOCUMENTS

| | | | |
|---|---|---|---|
| 669693 | 11/1929 | France | 114/366 |
| 715924 | 9/1954 | United Kingdom | 114/370 |
| 2092101 | 8/1982 | United Kingdom | 114/366 |

*Primary Examiner*—Galen L. Barefoot
*Assistant Examiner*—Stephen P. Avila
*Attorney, Agent, or Firm*—Shoemaker and Mattare, Ltd.

[57] ABSTRACT

Apparatus for launching a lifeboat, rescue craft or like small craft from a marine platform or other vessel in a bows-out heading comprises a boom mounted on the vessel that deploys outwardly as the boat is lowered and that carries a bow line releasably attached to the boat. The boom and bow-line are arranged so that the bow-line holds the boat in a bows-out heading after the boat has been lowered and on release of the fall or falls accelerates the boat away from the vessel.

3 Claims, 22 Drawing Figures

LAUNCHING APPARATUS FOR BOATS

FIELD OF THE INVENTION

This invention relates to improved apparatus for launching a lifeboat, rescue craft or like small boat from a ship, floating or fixed offshore marine platform or other vessel by which it is carried.

BACKGROUND TO THE INVENTION

Launching a survival craft from an offshore platform for emergency escape can be in the face of a combination of adverse circumstances, e.g. with the platform listing, in the dark, into dense smoke, into fire on the sea, into a toxic or flammable gas cloud, in high winds or against adverse tides. It is therefore desirable to launch the survival craft positively away from the platform and in a bows-out heading. One method which has been suggested is to launch the craft from a downwardly inclined chute extending partway from the platform to the sea, the balance of the distance being a free fall. Although this system can launch a boat away from the platform at a useful speed, it is expensive to install and subjects the passengers to high g-loads.

SUMMARY OF THE INVENTION

It is an object of the invention to provide launching apparatus that provides the following requirements:

1. Automation of the sequence of events from the initiation of the lowering of the survival craft, through the release of the fall wires from the lifting hooks to the final clearance of the parent vessel.
2. Control of the descent in terms of direction, stability in high winds and speed to suit wave conditions;
3. Prevention of 'wash back' and collision with parent vessel even if listing;
4. Directional control of the craft when waterborne to ensure that its own propulsive power is used to greatest effect in clearing the parent vessel; and
5. Provision of additional motive force in the desired direction away from the parent vessel to assist rapid clearance.

We have found that satisfactory results can be achieved by providing a flexible boom mounted on a hinge secured to the platform structure adjacent to the stowed survival craft. When not in use, the boom is secured in some way so as not to interfere with the working of the parent vessel. The length of the boom is approximately equal to the height of the stowed survival craft above the waterline.

A line known as a 'tag line' is attached to the outboard end of the boom and the other end is secured to the bow of the survival craft.

In operation, all personnel embark into the survival craft wearing lifejackets and secure themselves with seatbelts. All doors and hatches are closed and the engine started. Lowering is activated from within the craft and as it starts to descend, the tension thus induced in the 'tag line' causes the boom to hinge outwards and downwards to take up an approximate horizontal position pointing away from the platform. As the craft continues to descend further, the tagline causes the boom to flex downward like a giant fishing rod until the craft is waterborne. At this point, the engine throttle may be opened to full ahead, the lifting hooks released, and the tagline continues to exert a pull on the bow of the craft in both an upward and outward direction, until the craft has navigated the length of the boom away from the rig.

Only then, when the bow of the craft is directly under the tip of the boom, is the tagline released, by which time the propulsion unit will have attained its maximum thrust and the craft will have reached a speed in excess of six knots.

The invention therefore provides launching apparatus that permits a lifeboat, rescue craft or like small boat carried by a ship, floating or fixed offshore marine platform or other vessel to be launched positively away therefrom in a bows-out attitude, comprising a boom mounted on the vessel that deploys outwardly from the vessel as the boat is lowered and carries a bow-line releasably attached to the boat that is under tension as the boat is lowered, the arrangement being such that the bow-line holds the boat in a bows-out heading after the boat has been lowered and on release of the fall or falls accelerates the boat away from the vessel.

The whole process from the initiation of the descent to the release of the tagline may be entirely automatic. During the descent, the tension in the tagline steadies the craft in severe wind conditions and either (a) for twin falls, begins to rotate the survival craft so that it points away from the parent structure or (b) in the case of a single fall, rotates the craft a full 90° and maintains the position. When the survival craft is waterborne and the lifting hooks released, the tension in the tagline not only prevents it being washed back under the platform, but actually propels it away, while at the same time establishing and maintaining its desired direction and so maximising the benefits from its self-propulsion.

DESCRIPTION OF PREFERRED EMBODIMENTS

The falls are desirably connected to release means automatically triggered by a sensor to release the fall wires when the boat has reached the water. Preferably the release means is arranged to trigger a safety catch for a bow-line hook profiled so that the bow-line will not disengage the hook before or while it tows the boat.

Survival craft are desirably equipped with "On load" release gear. It is desirable that the survival craft lifting hooks be of the "On load" type with a hydrostatic operating unit, for use with the present apparatus so that (a) the craft cannot be accidentally released from the falls before contact with the water and (b) that the lifting hooks will open automatically immediately the craft contacts the water even with load on the hooks. The Mills "Titan" release gear complete with a modified hydrostatic operating unit can be retrofitted to existing survival craft to replace the Mills "Off Load" type, which are fitted to craft on most existing offshore installations.

BRIEF DESCRIPTION OF DRAWINGS

Embodiments of the invention will now be described with reference to the accompanying drawings, in which.

DETAILED DESCRIPTION OF PREFERRED EMBODIMENTS

Figure 1:
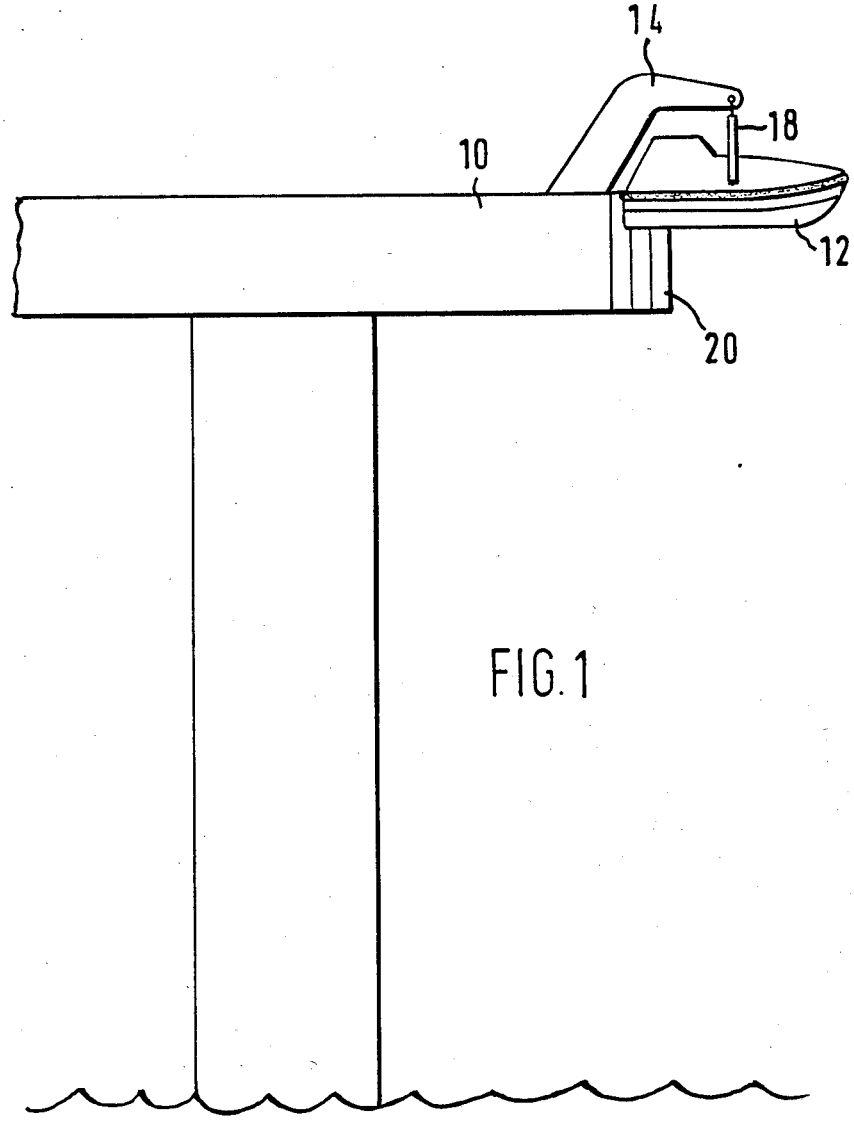
FIGS. 1 to 4 are views of a first embodiment of a bows-out boat launching apparatus according to the invention using a horizontally-articulated boom on a marine platform showing successive stages in boat launch.
Figure 2:
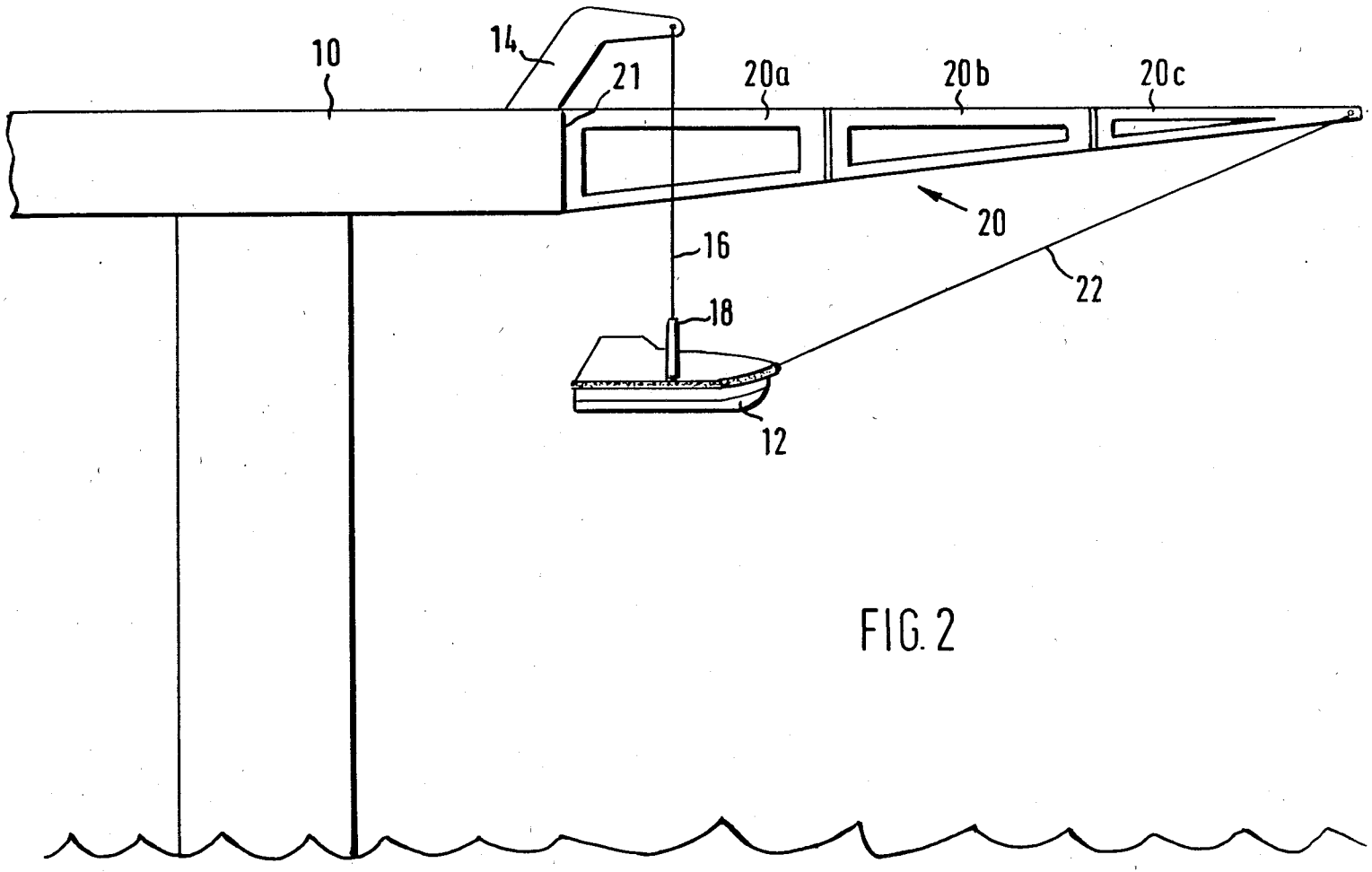
Figure 3:
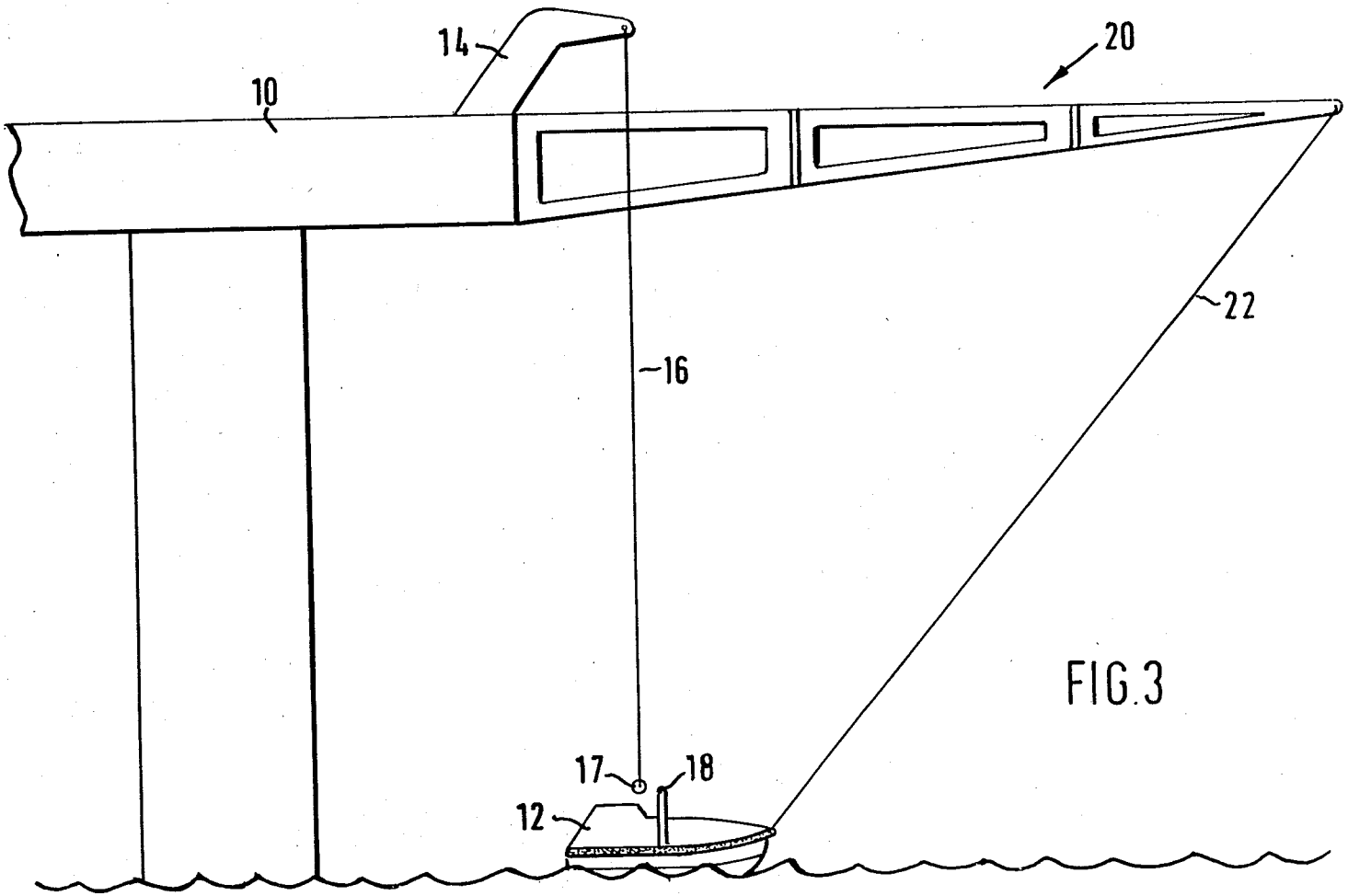
Figure 4:
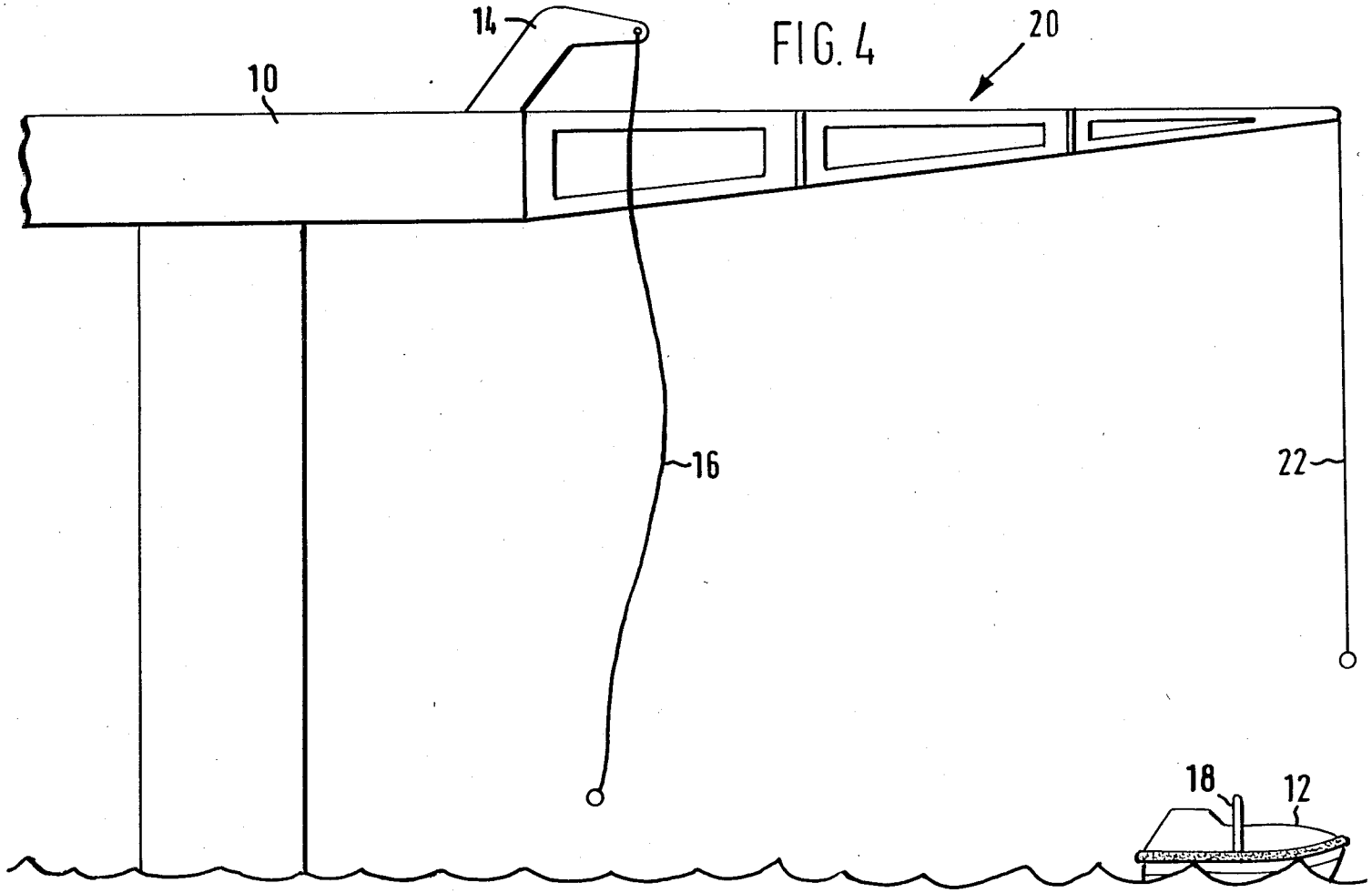

In FIGS. 1 to 4, an offshore marine platform for oil drilling or the like carries a boat 12 by means of a davit structure 14 that has at its extremity a sheave that pays out a single fall wire 16 connected by quick release gear to a support bar 18 of inverted U-shape that is fitted amidships transversely of the boat 12. Also fitted to the platform 10 is an articulated boom 20 constituted by hinged segments 20*a* to 20*c* that is shown in its stowed position in FIG. 1 and in its extended position in FIG. 2. The boom 20 is hinged to the platform 10 at 21 for rotation about a vertical axis and the individual segments 20*a* to 20*c* are hinged together. The extremity of the boom 20 carries a bow or tagline 22 which is paid out and taken up by a constant tension device to maintain a load of about 500 kg. The boom 20 may be driven to its extended position by a winch that is operated by the fall of the boat 12. When the boat 12 has reached the sea and is buoyant, release gear 17 (FIG. 3) that slidably engages the bar 18 is operated to release the fall wire, but the bow or tagline 22 maintains the boat 12 in a bows-out heading while the tension thereon assists the boat 12 to accelerate away from the platform 10. Finally the bow-line 22 is released as the boat 12 passes under the end of the boom 20 and at that time the boat is under way. If desired the functions of engine starting, fall lowering, gear selection, steering and fall 16 and bow-line 22 release may be controlled by a computer within the boat 12.

Figure 5A:
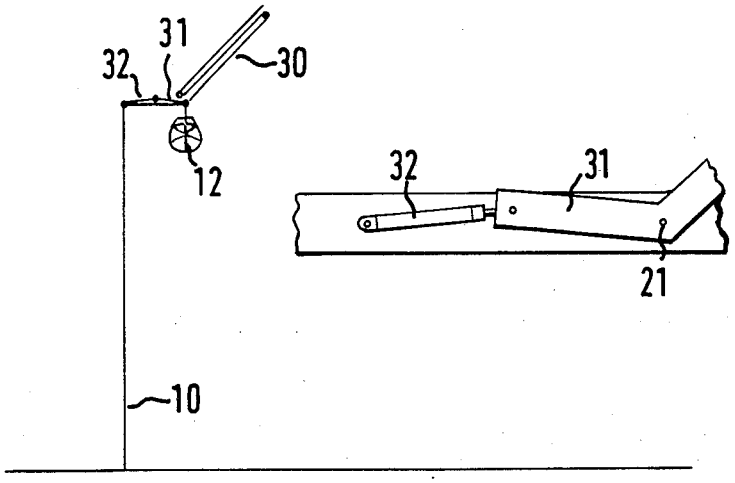
FIGS. 5*a* to 5*h* are diagrammatic views of an alongside boat-launching apparatus according to the invention using a vertically-articulated boom, the said views again showing successive stages of launching.
Figure 5B:
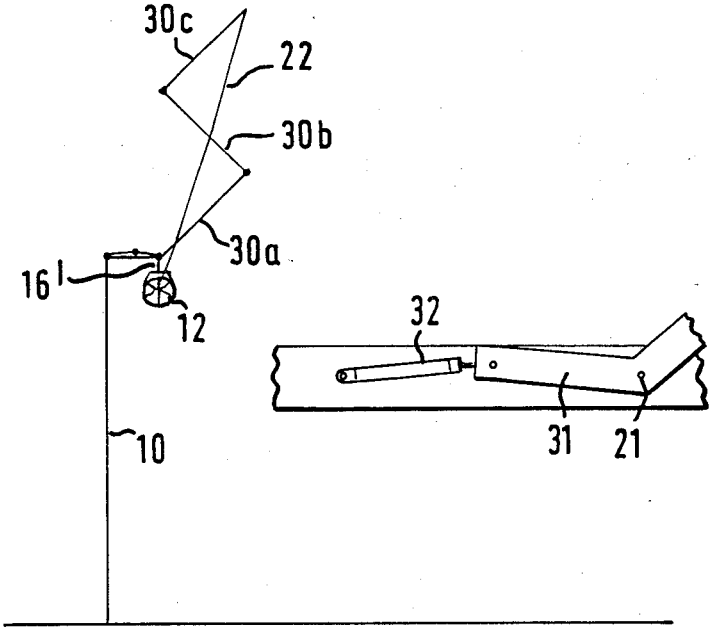
Figure 5C:
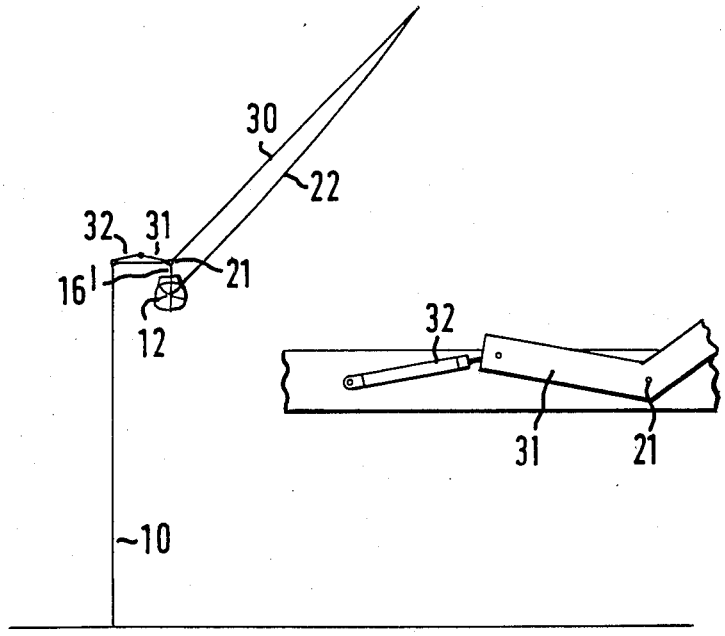
Figure 5D:
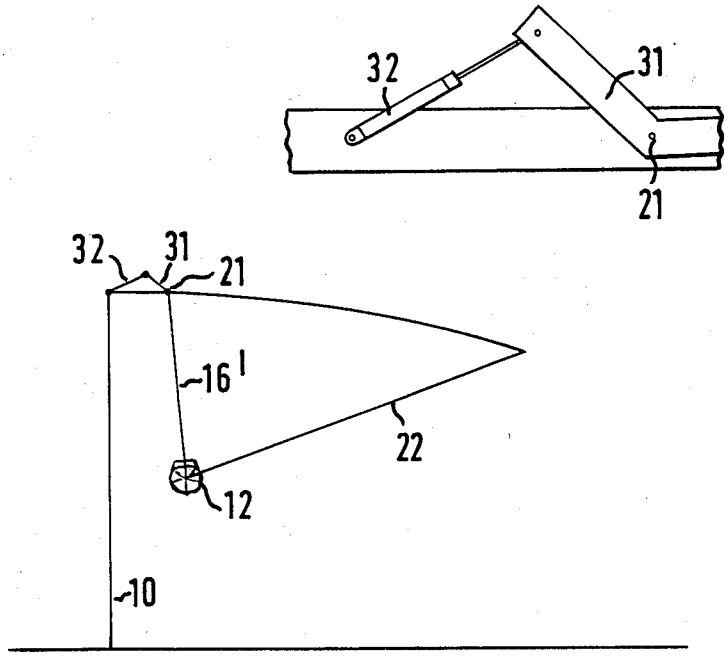
Figure 5E:
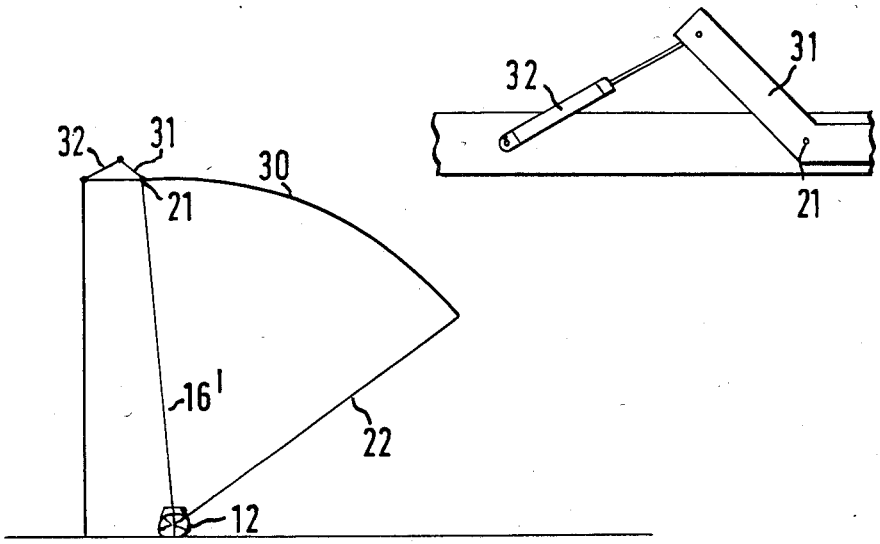
Figure 5F:
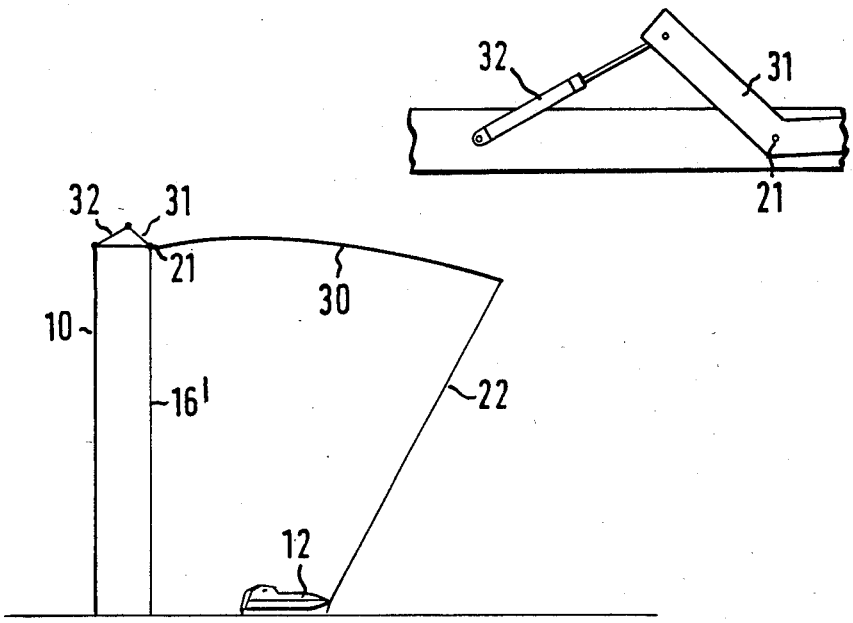
Figure 5G:
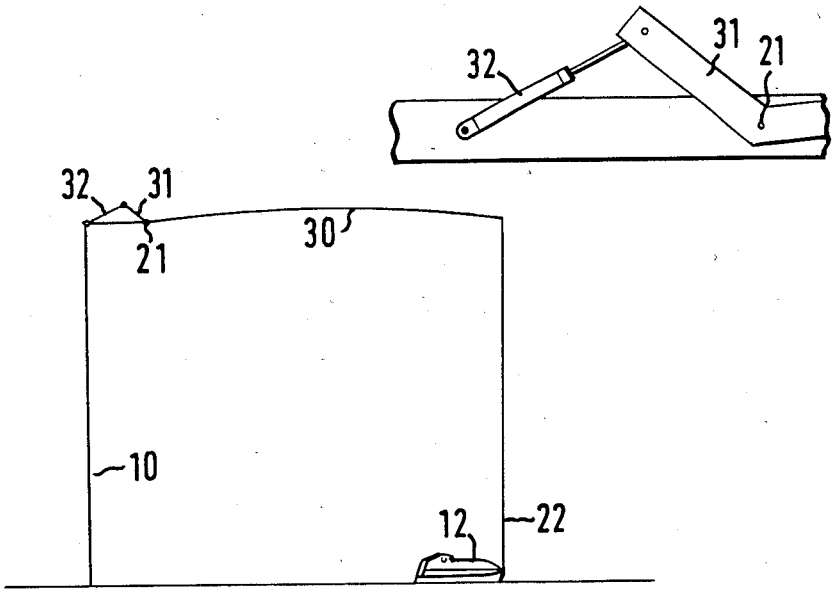
Figure 5H:
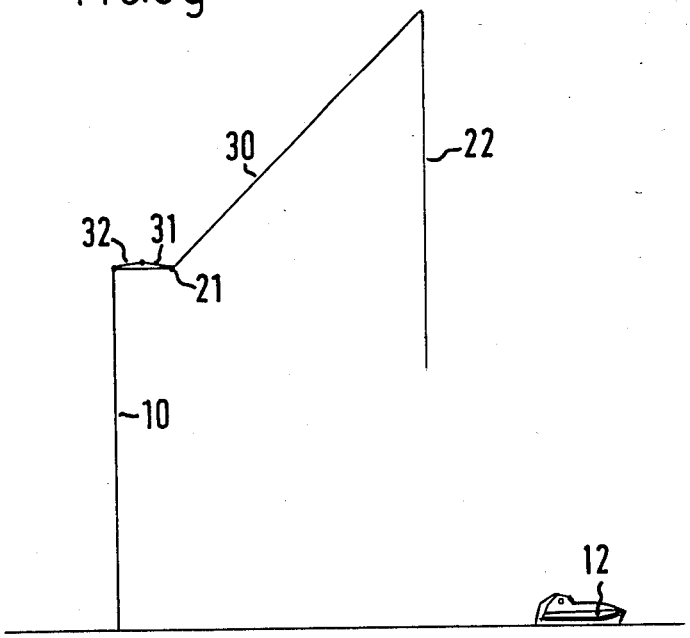

The arrangement of FIGS. 5*a* to 5*h* is similar except that the vertically-articulated boom 30 is hinged about a horizontal axis and the boat 12 is launched from an alongside rather than a bows-out position, there being twin falls in place of the single fall of FIGS. 1 to 4. The boom 30 is stowed at an angle of about 45° as apparent from FIG. 5*a*, and the boom is supported on a crank arm 31 that extends beyond the pivot 21 to define one part of a toggle linkage, the other part being defined by an oscillating cylinder 32. The first stage of launching is shown in FIG. 5*b* involves deployment of the segments 30*a* to 30*c* of the boom, before lowering of the boat 12 begins, and on complete boom deployment (FIG. 5*c*) the boom 30 is straight and is outwardly inclined at an angle of about 45°. Lowering of the boat 12 under the control of the twin falls 16′ and tagline 22 begins (FIG. 5*d*) and the toggle linkage is moved so as to extend the rod of cylinder 32 thereby storing energy in the cylinder 32 which tends to restore the boom to the attitude of FIG. 5*c*. When the position of FIG. 5*e* is reached the boat 12 is launched and the falls 16′ are released automatically. A suitable automatic release mechanism is described below, but any hydrostatically operated automatic release mechanism that operates to release the falls when the boat 12 is floating may be satisfactory. At FIG. 5*f* the falls 16′ have released and the tagline 22 has oriented the boat 12 in a bows-out attitude. Towing energy is provided partly by the stored energy in the toggle linkage 31, 32 and partly by the tendency of the bent boom 30 to straighten. At FIG. 5*g* the boat 12 has reached the end of the boom 30 and the tagline 22 no longer exerts a towing effect on the boat 12. It is therefore automatically released, after which the boom 30 returns to its neutral position (FIG. 5*h*) and the boat 12 continues away from the platform 10. Tank tests have shown that a launching mechanism of this kind can effectively launch the boat 12 in a bows-out attitude even under severe conditions and can impart a substantial component of velocity away from the platform to the boat 12.

Figure 6A:
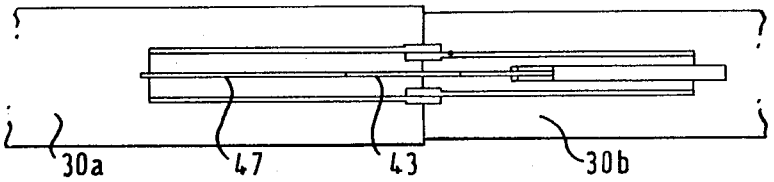
FIGS. 6*a* and 6*b* are plan and side views of an inner boom hinge fitted to the articulated boom of FIG. 5.
Figure 6B:
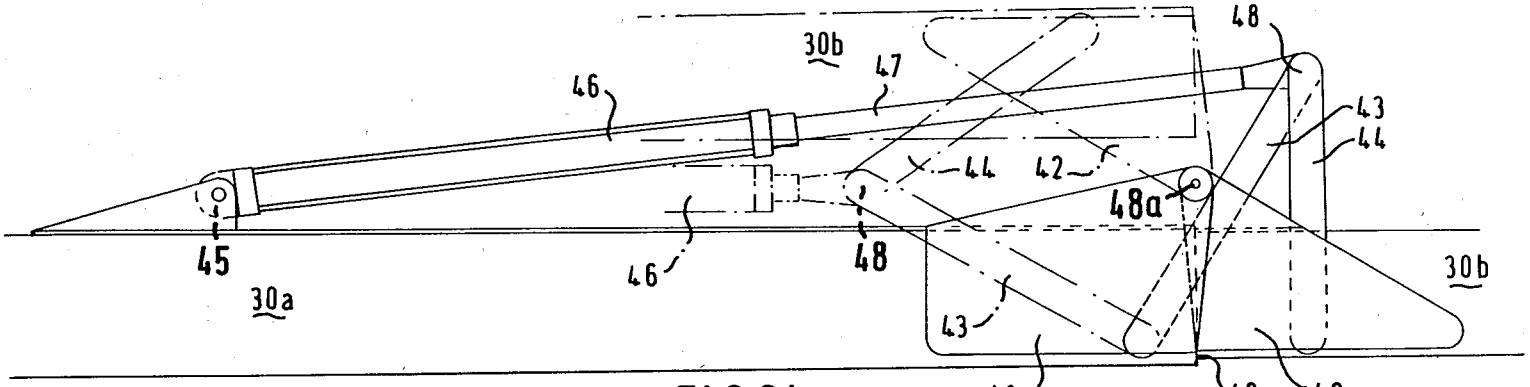

In FIGS. 6*a* and 6*b* the inner pair of segments 30*a*, 30*b* of the boom are hinged together by means of a hinge mechanism including plates 41, 42 attached to the respective segments and a pair of pivoted links 43, 44 connected between the plates 41, 42. The segment 30*a* pivotally supports at 45 a ram 46 whose rod 47 is connected to the knee joint 48 between links 43, 44. In the retracted position of the rod 47 (shown dotted) the segment 30*b* is folded back on the segment 30*a*, and extension of the rod 47 serves to rotate the hinge through the links 43, 44 to extend the segment 30*b* to the position shown in solid lines. It will be noted that the hinge pin 48 is uppermost and the segments 30*a*, 30*b* abut below the pin 48 at 49 so that the flexibility of the joint here is limited.

Figure 7A:
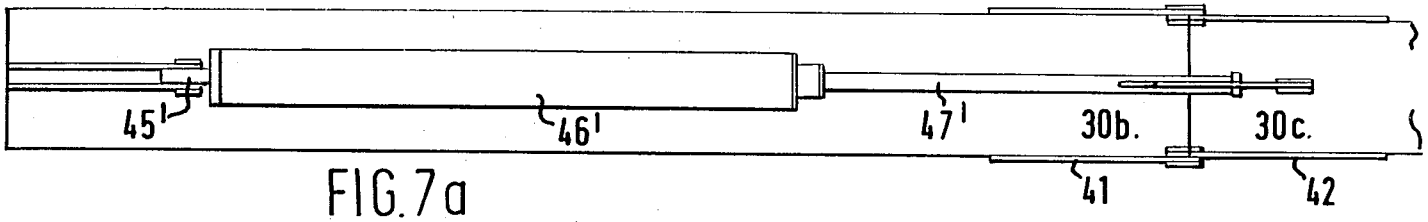
FIGS. 7*a* and 7*b* are plan and side views of an outer boom hinge fitted to the articulated boom of FIG. 5.
Figure 7B:
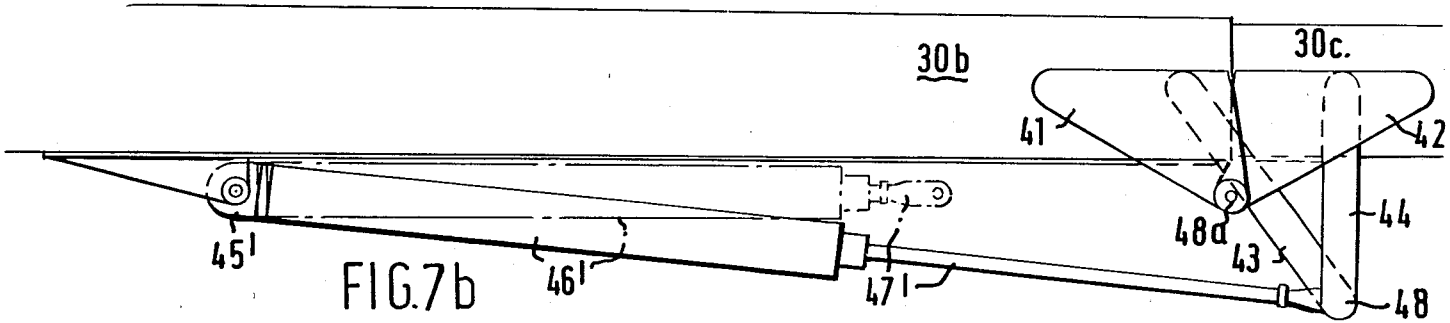

The arrangement of FIGS. 7*a* and 7*b* is substantially the same as that of FIGS. 6*a* and 6*b* except that in the straight position of the segments 30*b* and 30*c* the hinge pin 48*a* lies downwards. Tension on the segment 30*c* from the tagline 22 is transmitted via links 43, 44 as a compressive force to the ram 46 which gives a desirable degree of resilient flexibility to the joint between the outer segments 30*b* and 30*c*. It will be appreciated that the rams controlling the hinges between the inner and outer pair of segments are arranged, e.g. by appropriate flow control valves, to operate in a co-ordinated manner to deploy the boom segments without them interfering with the parent vessel or its operation.

Figures 8A, 8B, 8C, 8D:
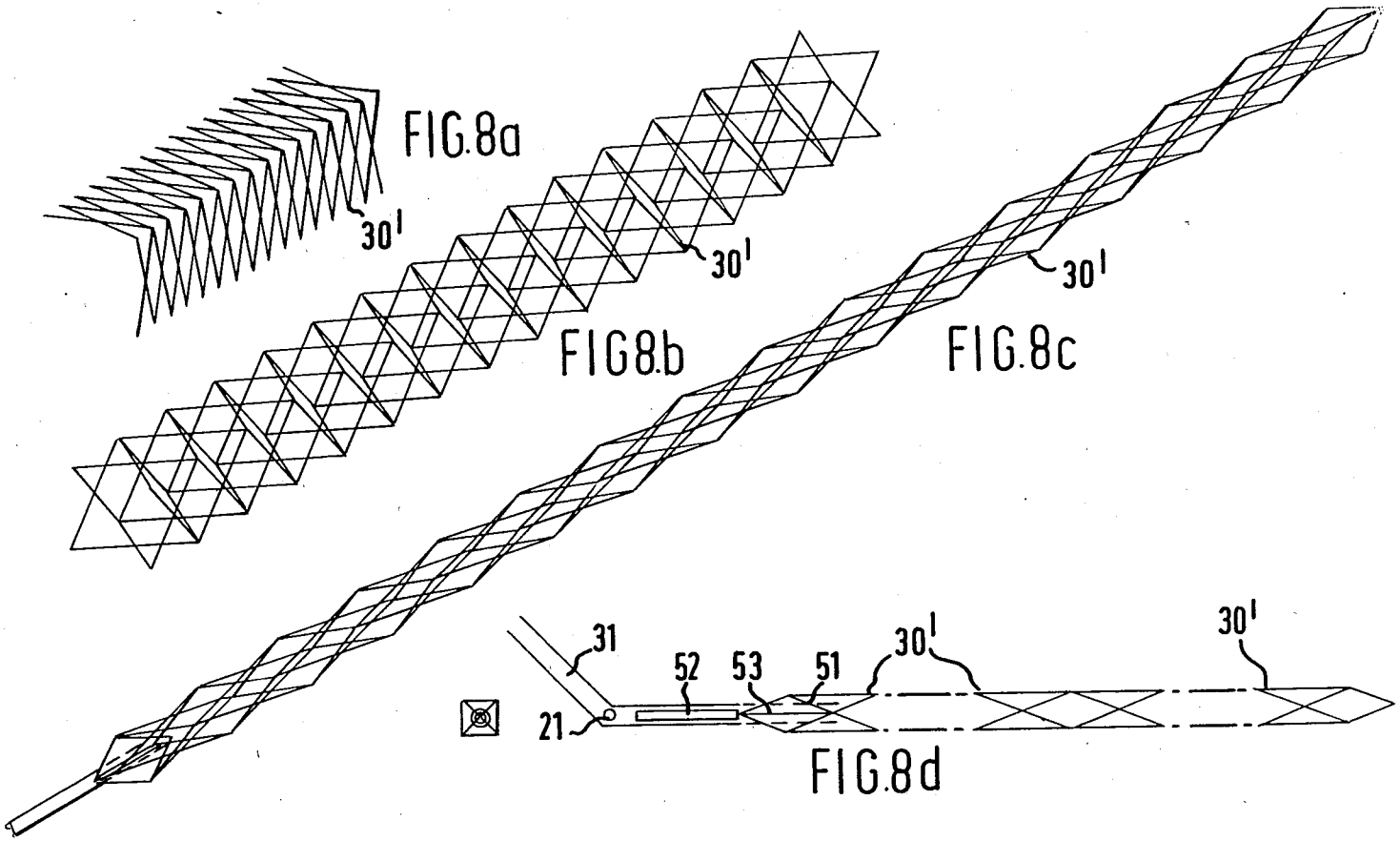
FIGS. 8*a* to 8*c* are diagrammatic perspective views in successive stages of extension of a lazy-tong boom for use in place of the articulated boom of FIGS. 5 to 7 and FIG. 8*d* is a diagram of the boom extension mechanism.

FIGS. 8*a* to 8*c* show an alternative boom construction in which the boom 30′ is made up by means of a multiplicity of lazy tong linkages arranged in a three or four sided framework. The base end of the boom 30′ has its links 51 operatively connected to rod 53 of ram 52 by which the boom can be extended and retracted.

Figure 9:
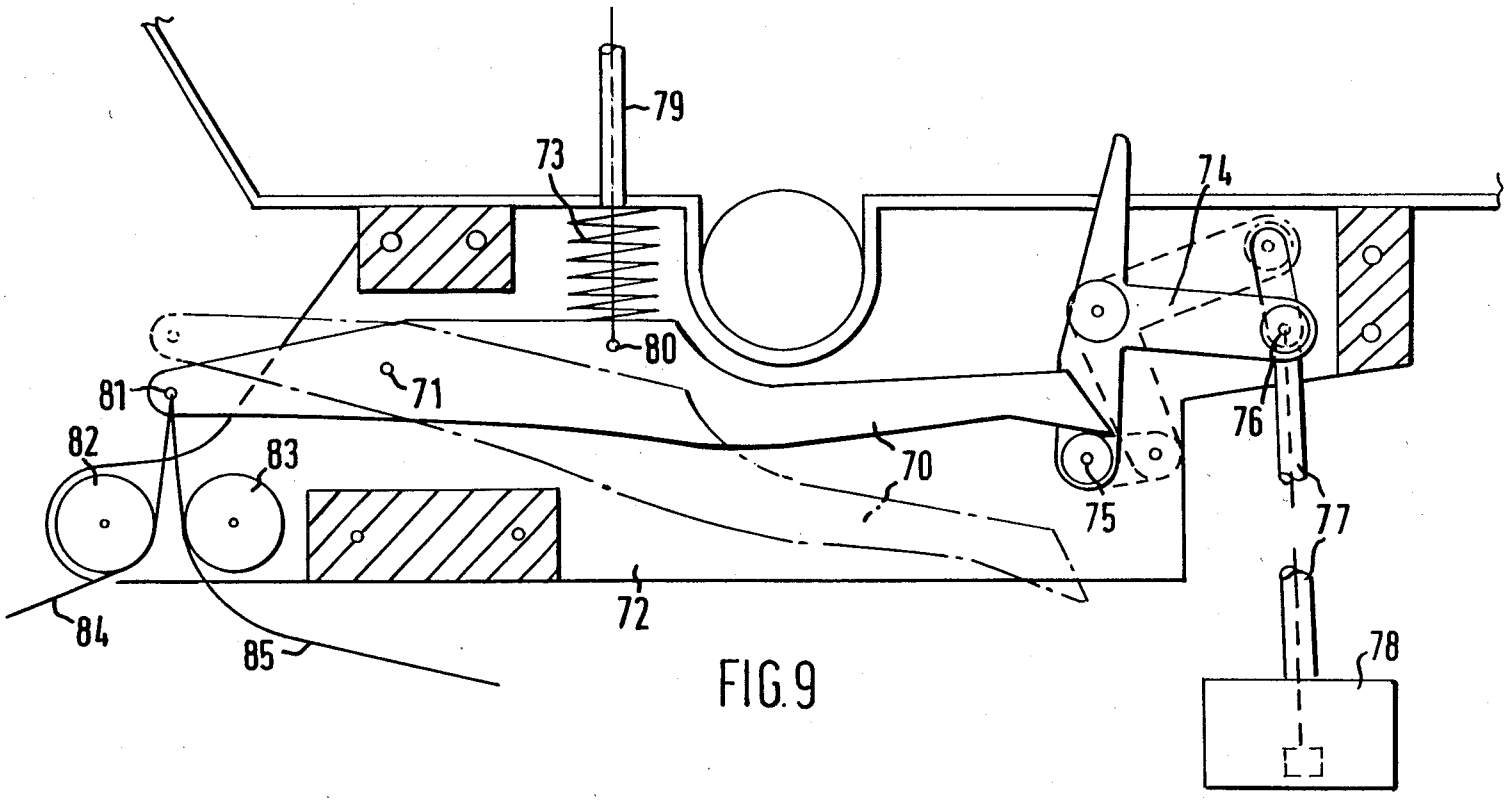
FIG. 9 is a diagram of an automatic falls release mechanism to be fitted in a boat to be launched by the method illustrated in the previous Figures.

An automatic release mechanism for a single fall wire 16 or for twin fall wires 16′ is shown in FIG. 9. An operating lever 70 is hinged at 71 between cheek plates 72 of a housing in the roof of the boat 12 and is biased clockwise as viewed by means of compression coil spring 73. It is normally held in a cocked position (solid lines) by means of a trigger that is also pivoted between the cheek plates 72. The trigger 74 is generally of bell-crank shape, one arm of which has a catch 75 that holds the operating lever 70 in the cocked position, and the other arm of which is connected at 76 to a release cable 77 operated by a float mechanism in the hull of the boat. When the boat is floating, the cable 77 rises, rotating the trigger 74 anticlockwise to the position shown dotted, after which the catch 75 is freed from the operating lever 70 which is rotated by spring 73 to its release position. For release of a single fall, a Bowden cable 79 may be attached at 80 to the operating lever 70 and is connected to a cable-operated release hook (not shown) on the support bar 18. For release of twin falls, operating wires 84, 85 are connected at 81 to the release lever 70 and pass fore and aft over sheaves 82, 83 to a bow release hook and a stern release hook respectively.

Figure 10:
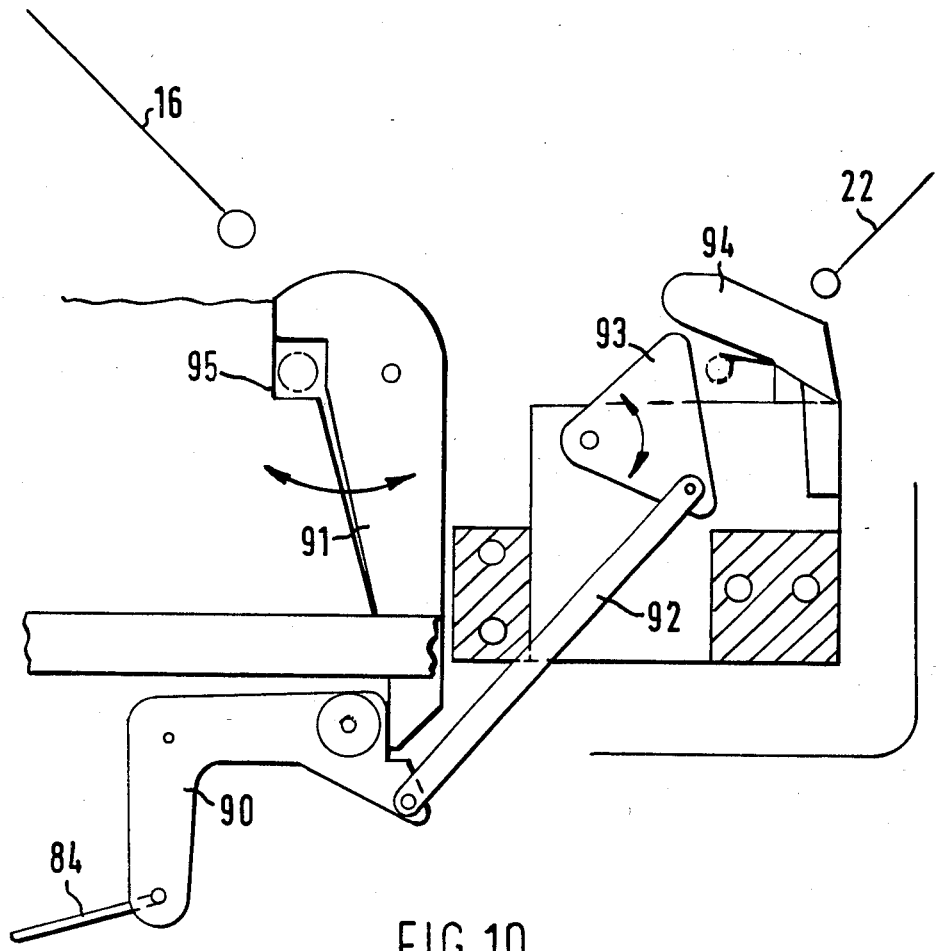
FIG. 10 is a diagram of a hook for the bow-line and a release hook for the falls operated by the automatic release mechanism of FIG. 9.

A suitable bow-line hook is shown in FIG. 10 and comprises a bell crank member 90 that in the locking position shown engages the lower end of a fall wire catch 91 to prevent rotation thereof and is also linked by pivoted link 92 to tagline catch 93 that cooperates with tagline hook 94 to hold captive the lower end of the tag line 22. Tension on the cable 84 rotates the bell-crank member 90 clockwise, releasing the catch 91 which rotates to release the lower end of fall 16' from recess 95 in which it had been held captive. Simultaneously the catch 93 is rotated by link 92 to free the lower end of the tag line 22. But the tagline is in a towing direction in the state indicated in FIG. 10 and FIGS. 5*e* and 5*f* and does not disengage from the hook 94 until the boat 12 has reached the position of FIG. 5*g* where towing ceases.

It will be appreciated that the invention provides a simple but effective way in which a boat that may initially be in a bows-out or alongside attitude may be launched positively away from the platform or vessel in a bows-out heading which provides an additional margin of safety where there is a fire or explosion hazard or under high wind/big sea conditions.

We claim:

1. Launching apparatus that permits a small boat carried by a vessel to be launched positively away therefrom in a bows-out attitude, including:

a boom mounted on the vessel that deploys outwardly from the vessel as the boat is lowered and when deployed extends substantially beyond the boat to be launched;

at least one fall by which the boat is lowered;

a bow-line carried by the boom and releasably attached to the boat;

means maintaining said bow-line under tension during boat descent and after the boat has reached the water so that said bow-line holds the boat in a bows-out heading and exerts a towing load thereon that after release of the fall accelerates said boat away from the vessel until it has passed the end of said boom;

wherein pivot means pivot the boom to the vessel for rotation about a horizontal axis, and biasing means connected between the vessel and the boom urges the boom towards a raised neutral position so that during launch of the boat the boom is pulled below its neutral position and the return action of the biasing means provides towing load to the bow-line.

2. Apparatus according to claim 1, wherein the biasing means is a gas spring or ram.

3. Launching apparatus that permits a small boat carried by a vessel to be launched positively away therefrom in a bows-out attitude, including:

a boom mounted on the vessel that deploys outwardly from the vessel as the boat is lowered and when deployed extends substantially beyond the boat to be launched;

at least one fall by which the boat is lowered;

a bow-line carried by the boom and releasably attached to the boat;

means maintaining said bow-line under tension during boat descent and after the boat has reached the water so that said bow-line holds the boat in a bows-out heading and exerts a towing load thereon that after release of the fall accelerates said boat away from the vessel until it has passed the end of said boom;

wherein the boom is flexible and stores towing energy.

* * * * *